United States Patent [19]

Beck et al.

[11] 4,069,131

[45] Jan. 17, 1978

[54] MOUNTING AND HOLDING FIXTURE FOR ELECTROPLATING UNIFORM THICKNESS METALLIC DEPOSITS

[75] Inventors: Heinz Beck, Wiesbaden-Dotzheim; Klaus Muller, Naurod, Taunus; Gerhard Erdelen, Wiesbaden, all of Germany

[73] Assignee: Glyco-Metall-Werke Daelen & Loos GmbH, Wiesbaden-Schierstein, Germany

[21] Appl. No.: 632,810

[22] Filed: Nov. 17, 1975

[30] Foreign Application Priority Data

Nov. 18, 1974 Germany ..... 2454625

[51] Int. Cl.[2] ..... C25D 17/06

[52] U.S. Cl. ..... 204/297 W; 204/287

[58] Field of Search ..... 204/281, 297 R, 297 W, 204/297 M, 287, 297

[56] References Cited

U.S. PATENT DOCUMENTS

| | | | |
|---|---|---|---|
| 2,727,858 | 12/1955 | Klein | 204/297 W |
| 2,761,831 | 9/1956 | Luechauer | 204/297 W |
| 2,944,945 | 7/1960 | Allison | 204/15 |
| 3,414,502 | 10/1968 | Porrata et al. | 204/281 |
| 3,779,890 | 12/1973 | Witney et al. | 204/297 R |

FOREIGN PATENT DOCUMENTS

| | | | |
|---|---|---|---|
| 573,635 | 11/1927 | United Kingdom | 204/297 W |

*Primary Examiner*—F.C. Edmundson

*Attorney, Agent, or Firm*—Strauch, Nolan, Neale, Nies & Kurz

[57] ABSTRACT

A mounting and holding fixture for electroplating semi-cylindrical articles especially radial journal bearing halves produced from a synthetic thermoplastic material by the thermoplastic foaming process.

4 Claims, 3 Drawing Figures

MOUNTING AND HOLDING FIXTURE FOR ELECTROPLATING UNIFORM THICKNESS METALLIC DEPOSITS

This invention concerns a mounting and holding fixture for semicylindrical articles which serves for electroplating a uniform thickness of metallic coatings, especially for the electrolytic plating of metals or metal alloys on the surface of halves of radial journal bearings.

In the electrolytic production of metal deposits on curved surfaces, it is difficult to obtain a uniform coating thickness. Especially configured mounting and holding fixtures are known for this purpose, which assure the desired flow of electrical current in the bath.

The known mounting and holding fixtures of this type are assembled, by adhesion or welding, from several individual physically suitable synthetic shapes. These shapes are usually produced by machining from block or plate materials. As a result of this production process, the surface properties as well as the dimensional accuracy of the mounting and holding fixtures do not always correspond to the desired quality requirements with respect to consistent quality.

It is necessary to form an initially greater wall thickness in order to make it possible to machine the above shapes and in order to obtain a better stability of the shapes. This not only causes higher material costs, but, primarily, the mounting and holding fixture produced in this manner may become heavy and cumbersome to handle.

Another disadvantage of this prior mounting and holding fixture results from the above mentioned adhesion or welding process, which is costly in itself. In spite of the greatest care in carrying out this work, the development of seams cannot be avoided, the seams being capable of letting electrolyte penetrate, and metallic or salty deposits take place which destroy the adhesion or welds in time. Thus, mounting and holding fixtures of this type require a costly maintenance system in order to remove the deposits from the seams before they finally destroy the joints.

Because of the configuration of the shapes as well as the adhesive and welded joints and the relatively great surface roughness, namely depth of roughness of the surface caused by machining, the useful life of the galvanic baths is shortened considerably in view of the high losses in the bath which are thus caused even if the mounting and holding fixture is left to drip off for a relatively long time between baths.

It is therefore the major object of this invention to provide a mounting and holding fixture for electroplating semicylindrical blanks, especially journal bearing halves and the like, having a low weight without deleteriously affecting stability, and considerably reducing losses in the bath through improved surface properites as well as through a better profile.

This is attained in accordance with this invention in that the mounting and holding fixture is produced in one piece, from a thermoplastic synthetic material, by the thermoplastic foaming process, which is resistant and inert with respect to the electrolytes.

Polypropylene has the advantage that it is stable with respect to temperature, wear resistant, and has a very high resistance to fracture. However, it is also possible to use polyvinyl chloride or polystyrol for the thermoplastic foaming process. This thermoplastic foaming process has the advantage that a uniform dimensional stability and uniform surface quality, with little depth of roughness, are assured. The use of the thermoplastic foaming process for mounting and holding fixtures is economically far superior to the conventional casting processes for these fixtures embodying epoxy resin with imbedded metal reinforcement. The invention offers the advantage of using synthetic materials for the production of mounting and holding fixtures, providing low impact sensitivity and high wear resistance because of the good plastic properties, which again makes possible longer useful lives for mounting and holding fixtures for galvanic baths and thus contributes to a considerble reduction in the costs of maintenance.

The thermoplastic foaming process for the production of one-piece mounting and holding fixtures for galvanic baths has the further advantage that production costs can be considerably reduced due to the reduction in the finishing time per article.

The drawings herein illustrate the body of a holding fixture that incorporates a fixture head of the type shown in the copending U.S. application for Letters Pat. Ser. No. 632,847 of Frederick Sauer and Klaus Muller filed on even date herewith. The articles to be electroplated are mounted in a magazine such as that disclosed in said copending application which is installed in the holding fixture body during the electroplating operation.

An embodiment of the invention is further described in combination with the drawing.

Figure 1:
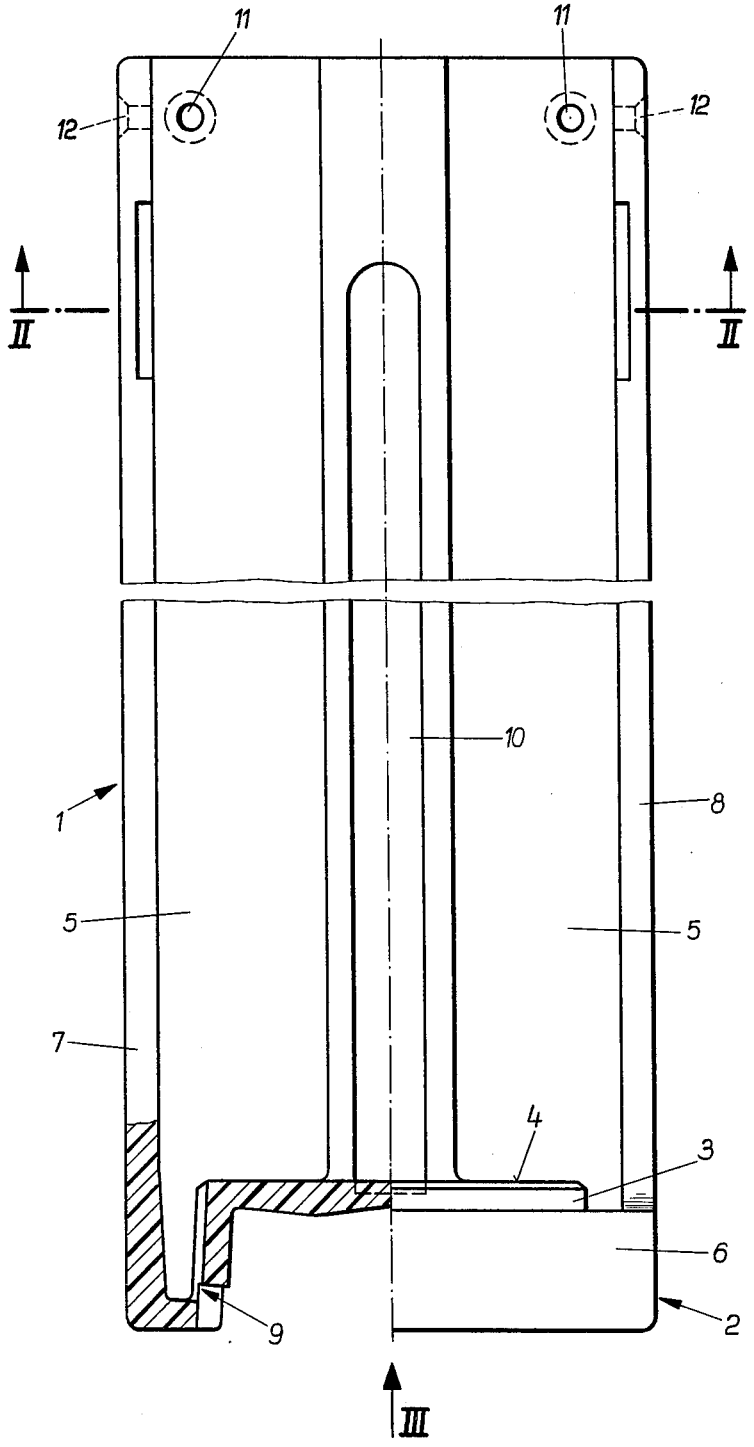
FIG. 1 is a front view of a mounting and holding fixture body in accordance with a preferred embodiment of the invention, in partial section.

FIG. 1 is a front view of a one-piece molded synthetic plastic mounting and holding fixture body 1 in accordance with this invention, produced by the thermoplastic foaming process. fixture body 1 has essentially a U-shaped profile (FIG. 2) and, at its bottom or foot 2, it is closed off by a semicircular platform 3, of which the top 4 serves as support surface for seating the journal bearing magazine (not illustrated) to be electroplated.

With the inside surface of the back wall 5, the support surface 4 intersects and forms a right angle. At a distance from platform 3, a wall 6 is provided, which is also semicircular and which is also connected, at the same time, with the side walls 7, 8 and the back wall 5 and provides a flat bottom for the fixture body.

Figure 3:
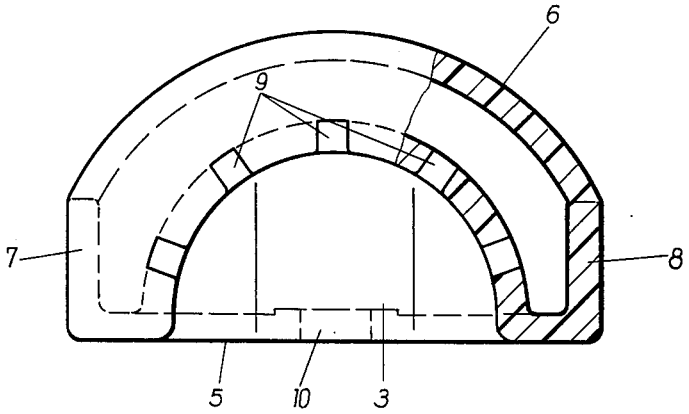
FIG. 3 is an enlarged bottom view taken substantially in the direction of the arrow III in FIG. 1, partially broken away.

At the base of foot 2, platform 3 is provided with circumferentially distributed molded openings 9, which allow the unimpeded flow of the electrolyte after fixture body 1 is taken out of the bath (FIG. 1 and FIG. 3).

Back wall 5 is provided with a centrally located elongated slot 10 (FIGS. 1 and 2), which is closed towards the foot 2 by the support surface comprising top surface 4 of platform 3 and which ends, at the upper end, at a distance from the upper edge of back wall 5.

Figure 2:
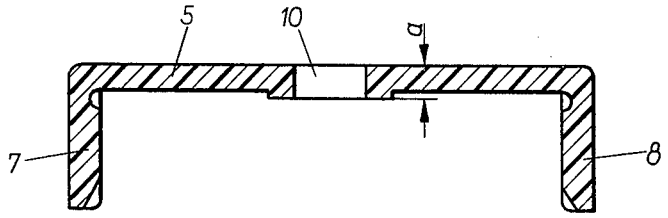
FIG. 2 is an enlarged section substantially on line II—II in FIG. 1.

As is further shown in FIG. 2, back wall 5 has an increased section in area *a* so that the necessary stability is maintained in spite of the formation of the longitudinal slot 10.

The upper open end of fixture body 1, which has a U-shaped profile, is provided with holes 11, 12 which are located in back wall 5 and side walls 7, 8 for the attachment of a current lead component (not illustrated), which extends over side walls 7, 8.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a device for mounting articles for electroplating in a galvanic bath system, an open-sided mounting and holding fixture body consisting of an integral one-piece member of molded synthetic plastic foamed material that is inert with respect to the electrolyte, said body having a back wall, a pair of side walls projecting from said back wall and a bottom wall extending across the lower ends of said back and side walls, said back wall being formed with a centrally located elongated slot for electrolyte flow, an integral platform projecting forwardly from said back wall and defining an upwardly facing article support surface in said body above the bottom wall and adjacent the lower end of said slot, and means defining electrolyte flow openings through said platform and bottom wall.

2. A device incorporting the mounting and holding fixture body in accord with claim 1 characterized in that the material consists of a material selected from the group consisting of foamed polypropylene, polystyrol, polyvinyl and polycondensates.

3. A device incorporating the mounting and holding fixture body in accord with claim 1, characterized in that said fixture body has said back wall joined to said side walls so as to provide a substantially U-shaped configuration, and said support platform projects within said configuration, said platform being spaced from said bottom wall and being formed with electrolyte flow openings adjacent its juncture with the bottom wall.

4. A device incorporating the mounting and holding fixture body defined in claim 1, wherein said platform surface is appreciably above the level of said bottom wall and said openings are distributed around the outer circumference of said surface.

* * * * *

UNITED STATES PATENT OFFICE

CERTIFICATE OF CORRECTION

Patent No. 4,069,131 Dated January 17, 1978

Inventor(s) Heinz Beck et al

It is certified that error appears in the above-identified patent and that said Letters Patent are hereby corrected as shown below:

Col. 2, line 12, change "considerble" to --considerable--.

Col. 2, line 41, change "fixture" to --Fixture--.

Col. 4, line 15, (claim 3, line 6), after "platform" insert --support surface--.

Signed and Sealed this

Sixteenth Day of May 1978

[SEAL]

Attest:

RUTH C. MASON
Attesting Officer

LUTRELLE F. PARKER
Acting Commissioner of Patents and Trademarks